US005325682A

United States Patent [19]

Chiang

[11] Patent Number: 5,325,682

[45] Date of Patent: Jul. 5, 1994

[54] WATER DISTRIBUTOR AND ICE CUTTER FOR A TUBE-ICE MACHINE

[76] Inventor: Sen-Mu Chiang, No. 28, Nung 30, Lane 151, Wu-Sheng Road, Tainan, Taiwan

[21] Appl. No.: 107,602

[22] Filed: Aug. 18, 1993

[51] Int. Cl.[5] ..... F25C 1/12

[52] U.S. Cl. ..... 62/320; 62/347

[58] Field of Search ..... 62/320, 347, 348, 352

[56] References Cited

U.S. PATENT DOCUMENTS

| | | | |
|---|---|---|---|
| 2,721,452 | 10/1955 | Brandin et al. | 62/320 |
| 2,949,752 | 8/1960 | Brayston | 62/320 |
| 4,378,680 | 4/1983 | Garland | 62/348 X |
| 4,464,910 | 8/1984 | Stultz | 62/320 |
| 4,522,039 | 6/1985 | McNeill | 62/320 |
| 4,651,537 | 3/1987 | Hagen | 62/320 |

*Primary Examiner*—William E. Tapolcai

*Attorney, Agent, or Firm*—Morton J. Rosenberg; David I. Klein

[57] ABSTRACT

A water distributor and an ice cutter for a tube-ice machine includes a water distributor having a cylindrical body, a multiangle head having two opposite spiraling water passageways and an air tube. Each of the water passageways are in fluid communication with the hollow interior of the multi-angle head to permit water to enter therethrough into one of a plurality of ice making tubes, to be frozen into a long bar of ice. Subsequently, the periphery of the bar of ice is melted to cause it to fall down from the ice making tube to an ice cutter. The ice cutter has ice cutting blades and sustain plates, held in a turning disc rotated by a motor, for cutting the long bar of ice into small pieces which are pushed out of an exit for use.

4 Claims, 4 Drawing Sheets

FIG. 2
(PRIOR ART)
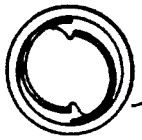
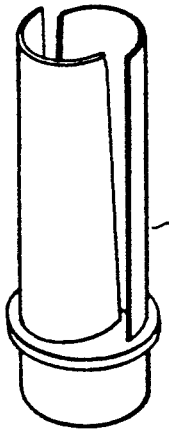
FIG. 3
(PRIOR ART)
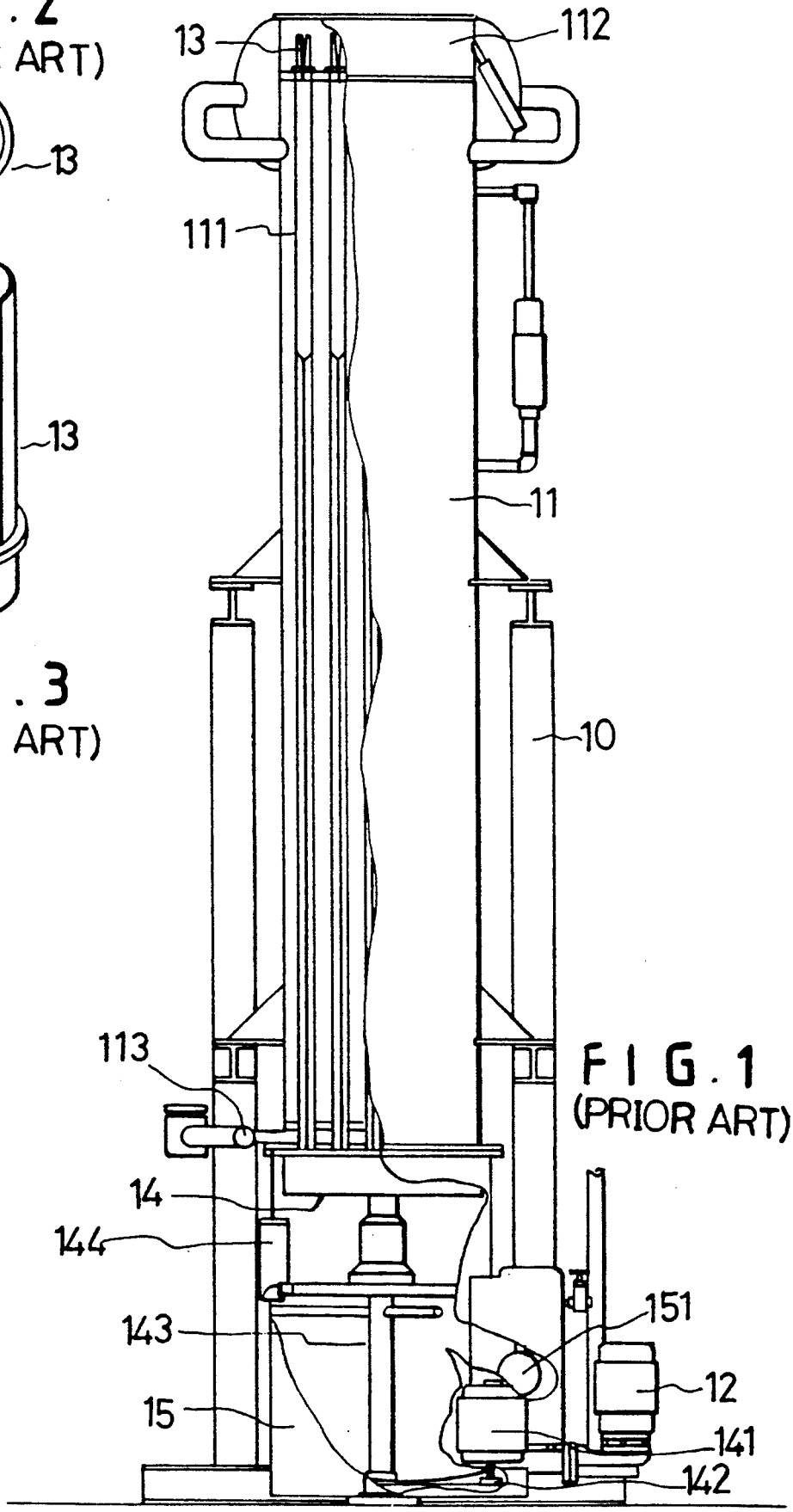
FIG. 1
(PRIOR ART)

WATER DISTRIBUTOR AND ICE CUTTER FOR A TUBE-ICE MACHINE

For a long time, ice has been made by a can ice machine, which produces ice blocks of large size, weighing 135 kg, and which need about 4 hours to freeze. A large crusher is needed to crush the ice block into small pieces for use. This way of making ice has the following drawbacks: (1) it takes a long time to make the block of ice, (2) it is difficult to keep impurities from the can during the process of making the ice, (3) hygiene is a problem during crushing or cutting of the block, and (4) a large space is required to accommodate the block of ice. Now, it is only used in fisheries, for freezing fish.

There are also rapid block ice machines and tube ice machines for making edible ice. The tube-ice machine is very popular because of its small dimensions and high productivity.

A conventional tube ice machine, shown in FIG. 1, includes a frame 10, a vertical vaporizer 11, a water pump 12, a water distributor 13, an ice cutter 14, a water tank 15 and a freezing system (not shown, as such is well-known in the art).

The vertical vaporizer 11 has a plurality of stainless steel ice making tubes 111, a water supply tank 112 at top, and a plurality of water distributors 13 fixed in top ends of the tubes 111 for water to flow down therein as a swirling water film along the inner wall surface of the ice making tubes 111, which are cooled by refrigerant to make long bars of ice in each of the tubes 111. The water which is not frozen therein, flows down through the ice cutter 14 into the water tank 15 and then to be pumped to the water supply tank 112 by the water pump 12, from which the water then flows down through the vertical vaporizer 11 again.

When the bars of ice in the ice making tubes 111 reach a predetermined height, refrigerant and water is stopped temporarily. Then, hot air is blown into the vertical vaporizer 11 to begin to met the bars of ice and cause them to fall down on the ice cutter 14, where they are cut into small pieces of ice.

The ice cutter 14 is operated by a transmitting shaft 143 rotated by a belt wheel 142 which is driven by a motor 141. The ice cutter 14 cuts the exposed bottom portions of the bars of ice off as they drop from the tubes 111. This cutting continues until all of the bars of ice are cut into small pieces, which are then pushed out of an exit 144, for use. After all of the bar ices are cut up, the compressor and the water pump again are started to supply refrigerant and water for the ice making tubes 111, repeating making process once again. The float valve 151 controls the flow of make-up water entering into the water tank 15.

The conventional water distributor 13 and the ice cutter 14, shown in FIGS. 1, 2 and 3, have disadvantages as follows:

1. The two V-shaped openings of the water distributor are unable to allow water entering therein to spread equally, to become a swirling film entering the ice making tubes, resulting in the bars of ice being frozen with a non-uniform thickness;

2. If the water in the water supply tank is in a sealed and pressurized condition, the volume of water entering through the V-shaped openings increased proportionally, as compared with the water tank in an unsealed and unpressurized condition, making it impossible to get an even quality of ice or even freezing effect;

3. The ice cutter is housed in the water tank, resulting in greater complexity of its structure, high cost and uneasy maintenance; and, 4. The transmitting shaft is hidden in the water tank, making it prone to rust, and it is too long to acquire good mechanical effectiveness.

SUMMARY OF THE INVENTION

This invention has been devised to offer an improved water distributor and an improved ice cutter for a tube-ice machine.

The water distributor in the present invention has a cylindrical body, two opposite passageways curved down through the cylindrical body, two flat surfaces on an inner wall surface of the cylindrical body for the two passageways to open through, and a bottom cone-shaped inner surface. A multi-angle head with a small vertical air tube extending through the head is formed with the cylindrical body.

The upper portion of the water distributor projects in a water supply tank, so water in the tank will flow through the two water passageways to flow down along the inner wall surface of the distributor, and through the cone-shaped bottom end thereof. The water then flows into the ice making tubes as a swirling water film to be frozen by the ice making tubes, which are cooled by refrigerant supplied by a freezing system.

The ice cutter in the present invention has a cylinder, a shaft sleeve in the center of the cylinder for vertically supporting a shaft of a turning disc. The turning disc has two opposite fan-shaped cutting blades and two opposite fan-shaped sustain plates. A net is formed at the bottom of the cylinder, and a motor rotates the turning disc by a combination of a small gear disposed on the shaft of the motor engaged with a large toothed circumferential edge of the turning disc.

When frozen bars of ice fall down from the ice making tubes, to expose the bottom end of each of the ice bars on the cutting blades and the sustain plates of the turning disc, small end portions of the motionless bar ices are cut by the turning blades. The cut portions drop down through openings formed between each blade and adjacent sustain plate, onto the net. The cut pieces are guided by a curved guide plate, and pushed out of an exit disposed at one side of the cylinder. The cutting operation continues until all of the bars of ice are cut up. Then, the ice making process is repeated.

BRIEF DESCRIPTION OF THE DRAWINGS

The invention will be better understood by reference to the accompanying drawings, wherein:

FIG. 1 is a perspective and partially cut-away view of a conventional tube-ice machine;

FIG. 2 is a cross-sectional view of a water distributor in the conventional tube-ice machine;

FIG. 3 is a perspective view of the water distributor in the conventional tube-ice machine;

DESCRIPTION OF THE PREFERRED EMBODIMENTS

Figure 4:
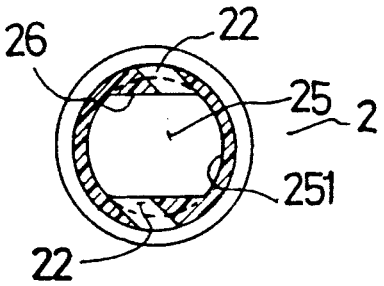
FIG. 4 is a cross-sectional view of a water distributor for a tube-ice machine in the present invention.
Figure 5:
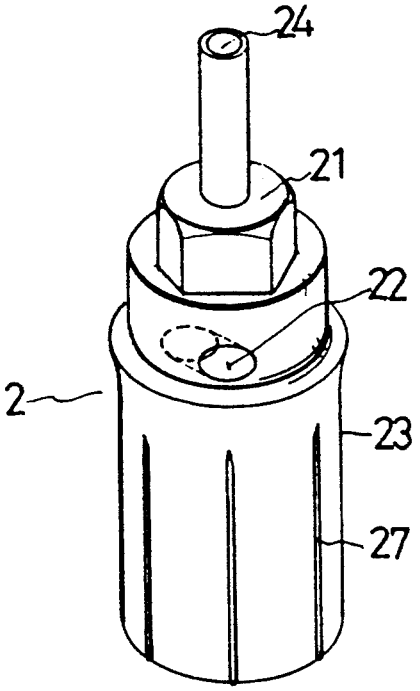
FIG. 5 is a perspective view of the water distributor for a tube-ice machine in the present invention.
Figure 6:
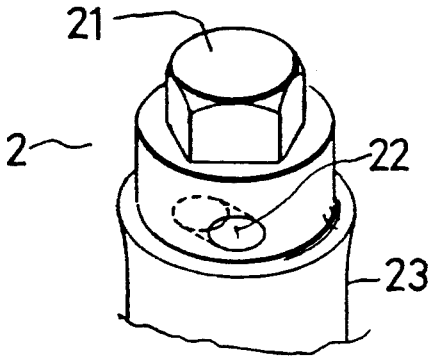
FIG. 6 is a perspective view of another water distributor for a tube-ice machine in the present invention.

A water distributor 2 for a tube-ice machine in the present invention, as shown in FIGS. 4, 5 and 6, includes a cylindrical body 23, a multi-angle head 21 formed on the top of the body 23, two opposing water passageways 22, 22 sloping down through the body 23. The cylindrical body 23 has a large diameter upper end portion and a small diameter portion disposed beneath the large diameter upper end portion. A small air tube 24 extends vertically through the head 21 to communicate with the hollow interior 25 of body 23. The two opposing water passageways 22, 22 are sloped downward to two opposing inner flat surfaces 26, 26. A plurality of projecting vertical ridges 27 are equally spaced on the outer surface of the cylindrical body 23, and a cone-shaped inner surface 28 is formed in the lower end thereof, as shown in FIG. 7.

Figure 7:
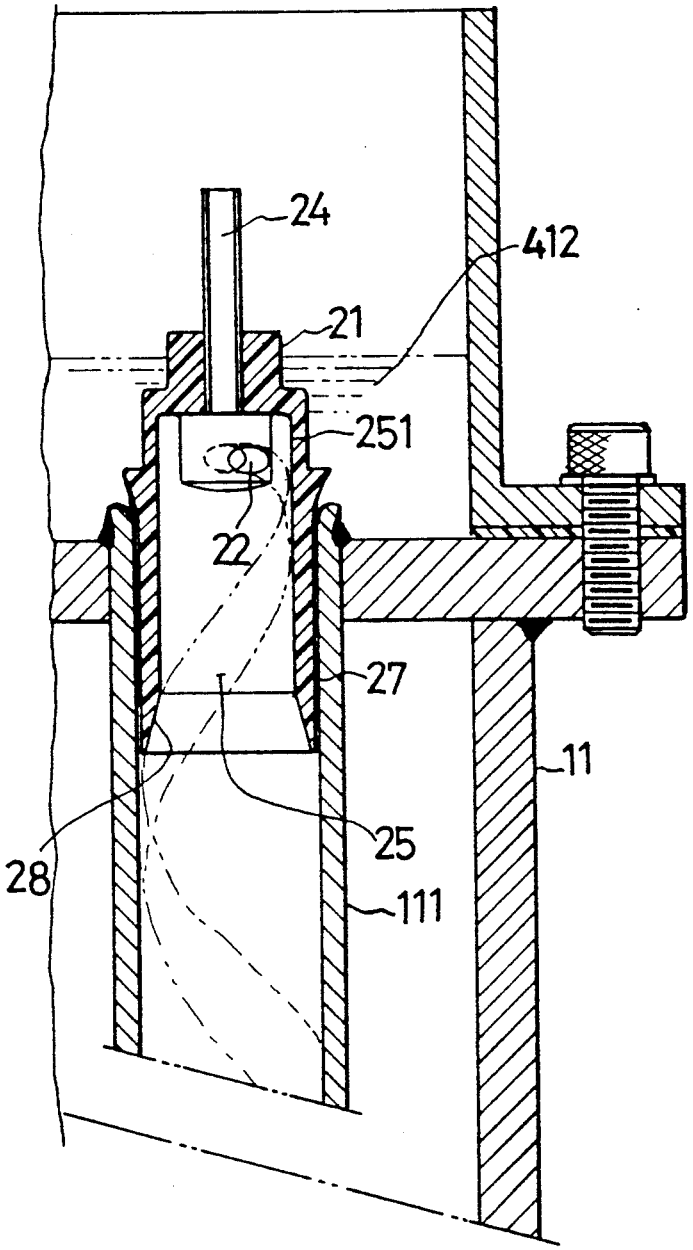
FIG. 7 is a cross-sectional view of the water distributor assembled in a tube-ice machine in the present invention.

In assembling the water distributor 2, as shown in FIG. 7, the cylindrical body 23 is inserted in an ice making tube 111 with the upper portion exposed on top of the ice making tube 111. The body 23 is frictionally engaged within tube 111 by means of the projecting ridges 27. Once the water 412 in a water supply tank 112 rises higher than the entrances to the water passageways 22, 22, water flows through the water passageways 22, 22 and then down along an inner surface 251 of body 23 as a swirling-down water film. The water then flows along the cone-shaped surface 28 onto an inner surface of the ice making tube 111, also as swirling-down water film. Meanwhile the ice making tube 111 is cooled by refrigerant surrounding the tube 111, freezing the water film flowing down the tube 111 into ice. And water not yet frozen flows into a water tank 15 to be pumped back to tank 112 for passage through the freezing tubes again.

The water distributor 2, with the small tube 24 which is open for air to flow therethrough, is used together with a water supply tank 112 that is not sealed or pressurized. Another water distributor 2, shown in FIG. 6, has no such tube 24, so it is used together with a sealed and pressurized water supply tank. Under pressure, the water flowing through the passageways 22, 22 has a larger speed than in the former embodiment, and swirling water film can then be better frozen into better quality ice, without any impurities.

Figure 8:
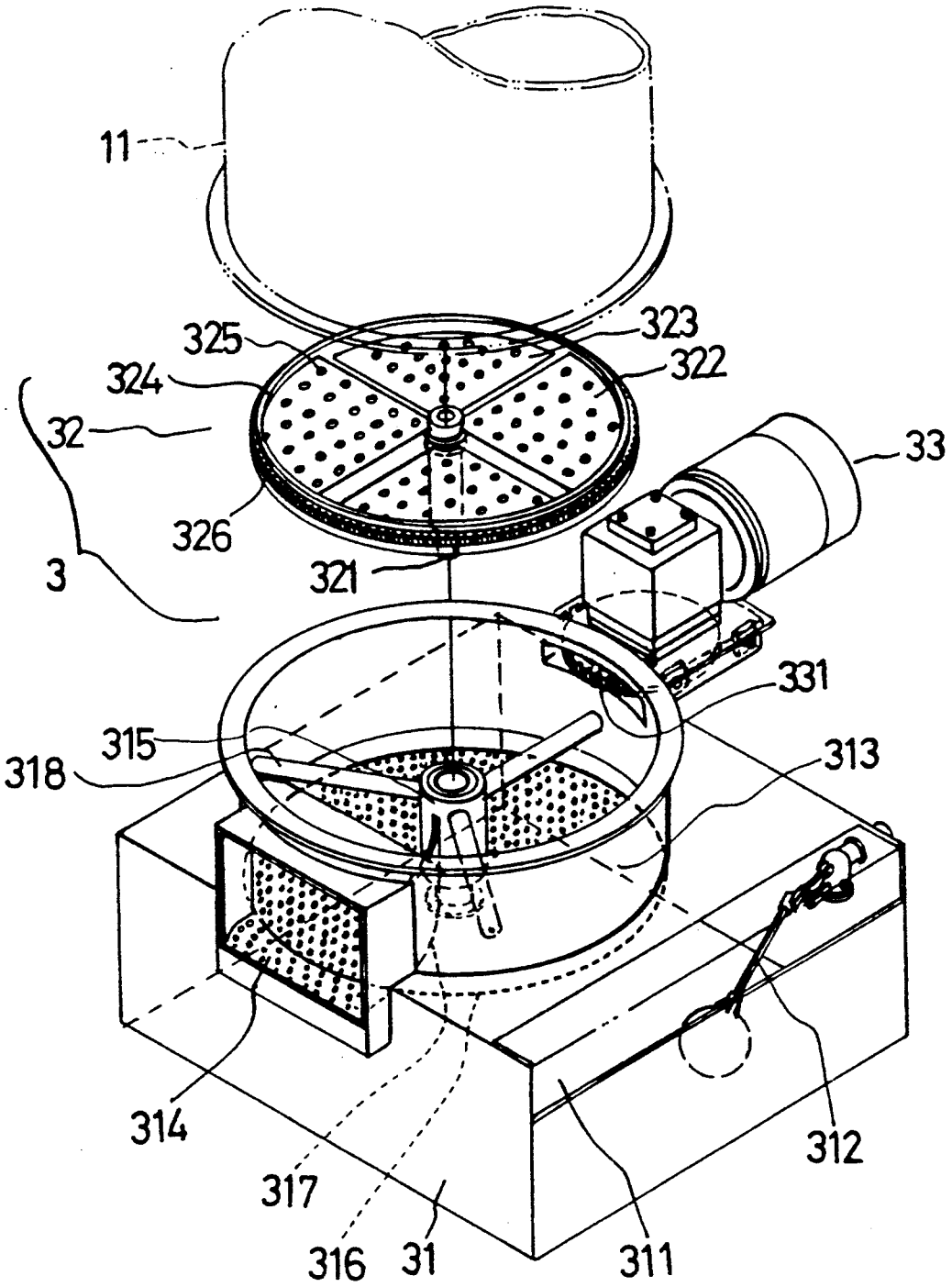
FIG. 8 is an exploded perspective view of an ice cutter for a tube-ice machine in the present invention; and, FIG. 9 is a cross-sectional view of the ice cutter assembled in a tube-ice machine in the present invention.

An ice cutter 3 for a tube-ice machine in the present invention, as shown in FIG. 8, includes a base case 31, a turning disc 32, and a motor 33 with a speed reducer. The base case 31 has a water storage portion 311 connected with a water source, the water source being connected through a float vale 312 for controlling the flow of water coming in to the storage portion 311. A cylinder 313 with a flange is fixedly coupled to the base case 31, and an ice exit 314 is formed through one side of the cylinder 313. A shaft sleeve 315 disposed vertically in the center of the cylinder 313, and a net 316 provided as the bottom of the cylinder 313. A curved guide plate 317 is provided to extend from an inner end of the exit 314 into the cylinder 313. The shaft sleeve 315 is supported by three radial arms 318 provided to extend between the shaft sleeve 315 and the inner surface of the cylinder 313.

The turning disc 32 has a shaft 321 fixed at its center, two opposing fan-shaped cutting blades 322, 322, two opposing fan-shaped plates 323,323 and a toothed outer circumference 324. The shaft 321 fits into the shaft sleeve 315, having its bottom end fixed firmly to the net 316. The cutting blades 322,322 and the sustain plates 323,323 are placed on different levels, the former being on a higher level than the latter. Both the cutting blades 322,322 and the sustain plates 323, 323 have a plurality of holes 325 formed therethrough for water to drip down.

Figure 9:
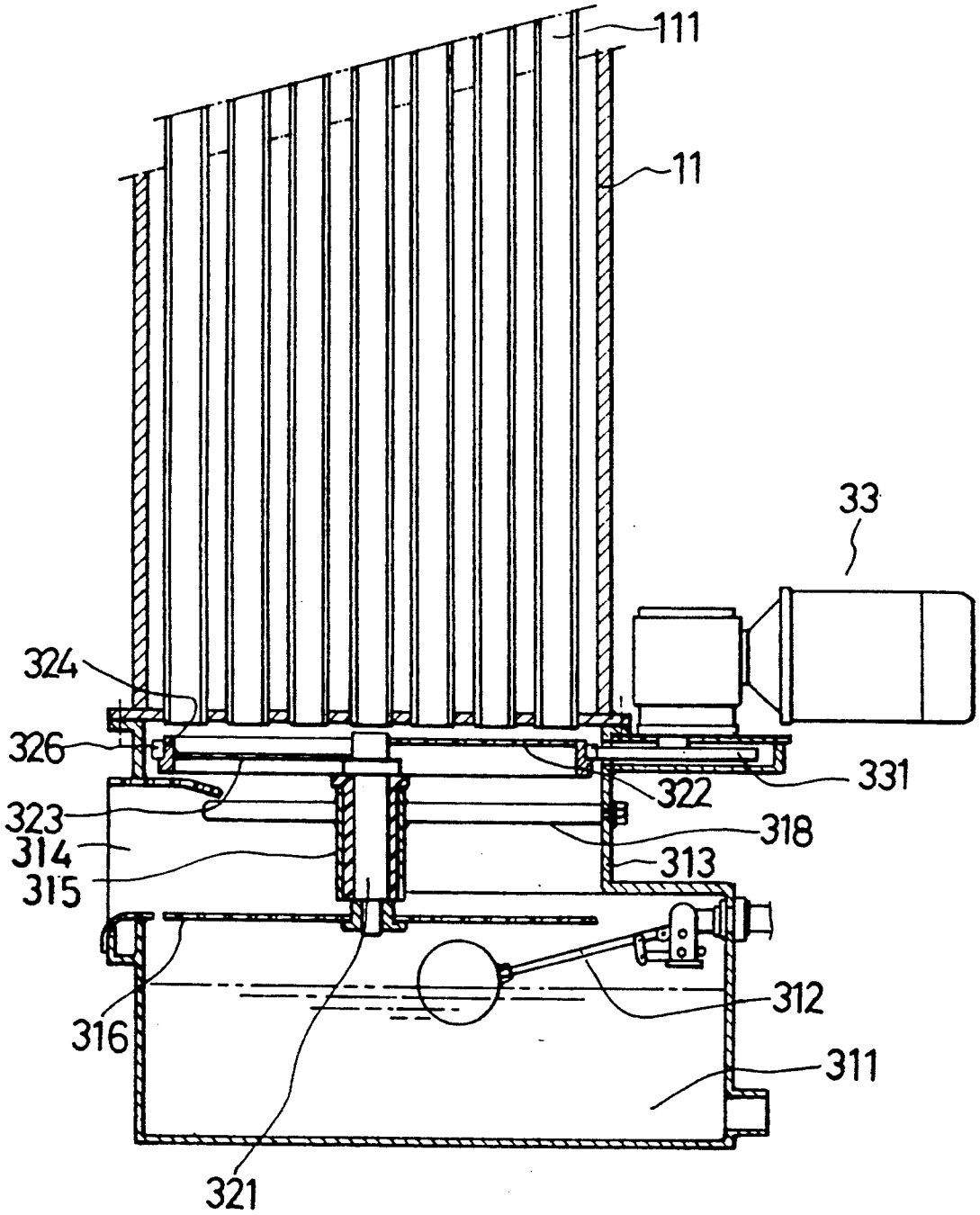

The motor 33 with a speed reducer is located at one side of the cylinder 313, having a small gear 331 fixed on its shaft. The small gear 331 protrudes into the cylinder 313 to engage the teeth 326 of the outer toothed circumference 324, as shown in FIG. 9. The turning disc 32 is therefore rotated by the motor 33, cutting bar ices with the cutting blades 322, 322.

When the ice cutter is in operation, the refrigerant and the circulating water are stopped, the bars of ice in the ice making tubes 111 having reached a preset height. Then, hot air is blown into a vaporizer 11 to heat the ice making tubes 111, forcing the bar ices therein to begin to melt and fall down onto the ice cutting blades 322,322 and the sustain plates 323,323 of the ice cutter 3. The lower end portions of the fallen bars of ice are cut off and become small pieces of ice which fall down through the openings between each adjacent cutting blade 322 and sustain plate 323 to the net 316. The net 316 is rotated by the shaft 321, moving the small pieces of ice to the guide plate 317, which guides the ice pieces through the exit 314 for use.

When the tubular bars of ice on the rotating cutting blades 322, 322 fall down onto the rotating sustain plates 323, 323, they are subsequently cut by the next pass of the rotating cutting blades 322, 322, and the cut-off small pieces can then drop down through the openings between each adjacent sustain plate 323 and cutting blade 322. The bars of ice temporarily supported on the rotating cutting blades 322, 322, until the sustain plates 323, 323 move to receive the bars of ice and repeat the cutting operation as the rotation of the turning disc continues. The hot air is stopped when the cutting operation is finished, and then refrigerant and water circulation is started again to repeat the ice making process.

The water distributor 2 and the ice cutter 3 in the present invention have desirable advantages over that of the conventional ice maker.

1. The two opposing sloped water passageways formed in the water distributor can allow almost the same quantity of water to enter the hollow interior of the distributor and swirl around down along the inner surface thereof. The swirling water film is frozen by the cooled ice making tube, with a definite quantity of water entering the water passageways. But, the conventional distributor has an indefinite quantity of water entering the water openings thereof.

2. The water distributor may include a small tube for passage of air into the hollow interior thereof, for use with an open and unpressurized water supply tank. Alternately, the distributor may not include the small tube for use with a sealed and pressurized water supply tank. In the latter case, the water quantity and flow rate of the pressurized water can force the water film spread on the inner surface of the ice making tube and any impurities mixed in the water to not be easily adhered on the inner surface of the tube, to produce a clean and more hygienic ice.

3. The motor of the ice cutter is provided at a location outside of the cylinder, positioned higher than the level of the base surface and is therefore less liable to become wet, simplifying the whole structure, raising effectiveness of the machine, and making maintenance easier.

While the preferred embodiments of the invention have been described above, it will be recognized and understood that various modifications may be made therein, and the appended claims are intended to cover all such modifications which may fall within the spirit and scope of the invention.

What is claimed is:

1. A water distributor and an ice cutter for use in a tube-ice machine having a frame, a compressor, a condenser, a water receiver, a float valve, a vertical vaporizer, a water distributor and an ice cutter, comprising:

a plurality of water distributors respectively fixed in an upper end of each of a plurality of ice making tubes vertically provided in said vertical vaporizer and cooled by refrigerant, a water supply tank provided at an upper end portion of said vertical vaporizer with each of said plurality of water distributors projecting therein, each said water distributor having a hollow cylindrical body, a plurality of vertical projecting ridges spaced around an outer surface of said cylindrical body for each said water distributor to distributor to insert tightly in said upper end of each of said ice making tubes, a multi-angled head formed at a top portion of said cylindrical body, two opposing water passageways, a float surface respectively formed on opposing sides of an inner surface of said cylindrical body for each said water passageway to open into said inner surface of said cylindrical body for water to flow through said water passageways and flow down along said inner surface as a swirling water film in said interior of said water distributor and an inner surface of a respective ice making tube;

an ice cutter provided under said vertical vaporizer, having a motor with a speed reducer, a cylinder fixed on a base case, a turning disc rotated by said motor, two opposite fun-shaped cutting blades fixed on a higher level and two opposite fan-shaped sustain plates fixed on a lower level of said turning disc, four straight openings formed between each adjacent cutting blade and sustain plate for cut-off ice pieces to fall down therethrough, a net formed as a bottom of said cylinder to receive ice pieces falling down through said openings, an exit provided at one side of said cylinder fixed on said base, a curved guide plate provided inside said exit to guide fallen ice pieces through said exit for use; and, each said water distributor receiving water from said water supply tank, water flowing as swirling water film through said two water passageways and along said inner surface of each said water distributor and said ice making tube and gradually frozen therein to become a long bar of ice, unfrozen water in said ice making tubes flowing through said ice cutter and into a water tank and pumped up again into said water supply tank for being recirculated through said ice making tubes, circulation of refrigerant and water being stopped temporarily responsive to each said ice making tube having completed making a long bar of ice therein, subsequently hot air being blown into said vertical vaporizer to melt said long bars of ice in each of said tubes, wherein said long bars of ice drop down on said ice cutter, a plurality of long bars of ice falling down on said sustain plates and said cutting blades to be cut by said blades rotating, cut-off ice pieces falling down through said openings between each said blade and each said sustain plate on said net and guided by said curved guide plate in said cylinder to be pushed out of said exit for use, each of said bars of ice having been cut being temporarily supported by said rotating blade and then falling on said sustain plate to be supported thereon and cut by one of said cutting blades into a small piece to fall down through said opening, cutting operation of said ice cutter continuing until all of said bars of ice are cut up.

2. A water distributor and an ice cutter for a tube-ice machine as claimed in claim 1, wherein said water distributor has a small tube vertically fixed through said multiangle head to communicate with said hollow interior thereof, applicable for a non-sealed and non-pressurized water supply tank by preventing the water distributor from being choked by a vacuum condition formed by said water distributor being filled with water.

3. A water distributor and an ice cutter for a tube-ice machine as claimed in claim 1, wherein said turning disc of said ice cutter has a toothed outer circumference to engage with and be rotated by a small gear fixed on a shaft of said motor with a speed reducer.

4. A water distributor and an ice cutter for a tube-ice machine as claimed in claim 1, wherein said turning disc of said ice cutter has a central shaft extending in a shaft sleeve held at a center portion of said cylinder by three radial arms, said shaft having its bottom end fixed on said net formed as said bottom of said cylinder, said net receiving cut small ice pieces thereon, said ice pieces being guided by a curved plate to be pushed out of said exit fixed at one side of said cylinder for use.

* * * * *

UNITED STATES PATENT AND TRADEMARK OFFICE

CERTIFICATE OF CORRECTION

PATENT NO. : 5,325,682

DATED : July 5, 1994

INVENTOR(S) : Sen-Mu Chiang

It is certified that error appears in the above-identified patent and that said Letters Patent is hereby corrected as shown below:

IN THE TITLE: (Cover page item [54] and Column 1, Line 3)

Delete the word "TUBE-ICE" and insert therefor the words --TUBULAR ICE MAKING--.

IN THE ABSTRACT, Line 1, delete the words "tube-ice" and insert therefor the words --tubular ice making--.

Column 1, Line 16, delete the words "tube ice" and insert therefor the words --tubular ice making--.

Column 1, Line 17, delete the words "tube-ice" and insert therefor the words --tubular ice making--.

Column 1, Line 20, delete the words "tube ice" and insert therefor the words --tubular ice making--.

Column 2, Line 11, delete the word "tube-" and insert therefor the word --tubular--.

Column 2, Line 12, after the word "ice" insert the word --making--.

Column 2, Line 55, delete the words "tube-ice" and insert therefor the words --tubular ice making--.

Column 2, Line 57, delete the words "tube-ice" and insert therefor the words --tubular ice making--.

Column 2, Line 59, delete the words "tube-ice" and insert therefor the words --tubular ice making--.

Column 2, Line 61, delete the words "tube-ice" and insert therefor the words --tubular ice making--.

UNITED STATES PATENT AND TRADEMARK OFFICE

CERTIFICATE OF CORRECTION

PATENT NO. : 5,325,682

DATED : July 5, 1994

INVENTOR(S) : Sen-Mu Chiang

It is certified that error appears in the above-identified patent and that said Letters Patent is hereby corrected as shown below:

Column 2, Line 63, delete the words "tube-ice" and insert therefor the words --tubular ice making--.

Column 2, Line 65, delete the words "tube-ice" and insert therefor the words --tubular ice making--.

Column 2, Line 67, delete the words "tube-ice" and insert therefor the words --tubular ice making--.

Column 3, Line 2, delete the words "tube-ice" and insert therefor the words --tubular ice making--.

Column 3, Line 5, delete the words "tube-ice" and insert therefor the words --tubular ice making--.

Column 3, Line 9, delete the words "tube-ice" and insert therefor the words --tubular ice making--.

Column 3, Line 54, delete the words "tube-ice" and insert therefor the words --tubular ice making--.

Column 5, Line 16, delete the words "tube-ice" and insert therefor the words --tubular ice making--.

Column 6, Line 33, delete the words "tube-ice" and insert therefor the words --tubular ice making--.

Column 6, Line 41, delete the words "tube-ice" and insert therefor the words --tubular ice making--.

UNITED STATES PATENT AND TRADEMARK OFFICE

CERTIFICATE OF CORRECTION

PATENT NO. : 5,325,682

DATED : July 5, 1994

INVENTOR(S) : Sen-Mu Chiang

It is certified that error appears in the above-indentified patent and that said Letters Patent is hereby corrected as shown below:

Column 6, line 46, delete the words "tube-ice" and insert therefor the words —tubular ice making—.

Signed and Sealed this

Seventh Day of November, 1995

Bruce Lehman

*Attest:*

BRUCE LEHMAN

*Attesting Officer*

*Commissioner of Patents and Trademarks*